US007445246B1

(12) United States Patent
Wagschal et al.

(10) Patent No.: US 7,445,246 B1
(45) Date of Patent: Nov. 4, 2008

(54) CLIPBOARD ASSEMBLY

(75) Inventors: Edward A. Wagschal, New York, NY (US); R. Christopher Kidd, New York, NY (US); Gary L. Hellinger, Greenwich, CT (US)

(73) Assignee: Gary Plastic Packaging Corp., Bronx, NY (US)

( * ) Notice: Subject to any disclaimer, the term of this patent is extended or adjusted under 35 U.S.C. 154(b) by 0 days.

(21) Appl. No.: 11/945,885

(22) Filed: Nov. 27, 2007

(51) Int. Cl.
*B42D 3/00* (2006.01)
*A47B 97/04* (2006.01)

(52) U.S. Cl. ..... 281/45; 281/46; 281/49; 248/451; 248/452; 24/67 R

(58) Field of Classification Search ..... 248/447, 248/447.2, 451, 452, 453, 222.11, 222.12; 24/67 R, 67.3, 67.7; 108/43; 281/45, 48, 281/49
See application file for complete search history.

(56) References Cited

U.S. PATENT DOCUMENTS

| | | | | | |
|---|---|---|---|---|---|
| 1,422,489 | A | | 7/1922 | Smith | |
| 1,460,502 | A | | 7/1923 | Rudesill | |
| 1,566,695 | A | | 12/1925 | Raschick | |
| 1,800,362 | A | | 4/1931 | Shipman | |
| 1,913,050 | A | | 6/1933 | Furlong | |
| 2,548,389 | A | | 4/1951 | Neikirk | |
| 2,646,993 | A | | 7/1953 | Schwer | |
| 2,943,372 | A | * | 7/1960 | Fleming | 24/67.7 |
| 3,216,742 | A | | 11/1965 | Strain | |
| 3,297,862 | A | | 1/1967 | Levy et al. | |
| 3,403,641 | A | * | 10/1968 | Baker | 108/152 |
| 4,401,323 | A | * | 8/1983 | Rex | 281/45 |
| 4,501,438 | A | | 2/1985 | McKee | |
| 4,628,572 | A | * | 12/1986 | Chang | 24/67.11 |
| 4,763,389 | A | * | 8/1988 | Chang | 24/67.11 |
| 4,948,172 | A | | 8/1990 | Chang | |
| 4,961,249 | A | | 10/1990 | Liu et al. | |
| 5,035,389 | A | * | 7/1991 | Wang | 248/224.51 |
| 5,145,141 | A | * | 9/1992 | Hunter | 248/452 |
| D334,213 | S | | 3/1993 | Evenson | |
| 5,226,215 | A | | 7/1993 | Evenson | |
| 5,288,530 | A | * | 2/1994 | Maki | 428/31 |
| 5,312,082 | A | * | 5/1994 | Chang | 248/452 |
| 5,364,057 | A | | 11/1994 | Pynenburg | |
| 5,385,282 | A | * | 1/1995 | Chen | 224/669 |

(Continued)

FOREIGN PATENT DOCUMENTS

| | | |
|---|---|---|
| DE | 40 18 556 | 9/1991 |

*Primary Examiner*—Kimberly T. Wood
(74) *Attorney, Agent, or Firm*—Ropes & Gray LLP; Jeffrey H. Ingerman

(57) ABSTRACT

A clipboard may be assembled from a backboard and a clip assembly by sliding the clip assembly onto the top edge of the backboard. The clip assembly and the backboard are shaped so that the clipboard assembly has a substantially continuous contour along its top edge. Specifically, the top edge of the backboard is spaced away from the remainder of the top edge in the area where the clip assembly is attached. The amount of spacing away corresponds to the thickness of a lip that depends from the clip assembly and engages the top edge or the backboard in the area where the clip assembly is attached. The clip assembly is retained on the backboard by flanged rails that engage slots in the backboard and by ramped projections that engage detents and the backboard.

14 Claims, 6 Drawing Sheets

U.S. PATENT DOCUMENTS 5,413,382 A 5/1995 Cornell et al.
5,620,162 A 4/1997 Beckwith et al.
5,658,014 A 8/1997 Barker et al.
5,732,925 A * 3/1998 Shamoon ..... 248/452
5,765,794 A * 6/1998 Chen ..... 248/292.12
6,082,688 A * 7/2000 Wilson ..... 248/222.11
6,105,182 A * 8/2000 Elnar ..... 4/541.1
6,147,858 A * 11/2000 Takahashi ..... 361/680
6,213,517 B1 4/2001 Goluszka et al.
D446,549 S 8/2001 Cheris et al.
6,386,589 B1 5/2002 Yuh
6,405,910 B1 6/2002 Infanti et al.
6,637,707 B1 * 10/2003 Gates et al. ..... 248/224.7
6,637,774 B2 10/2003 Gaska
6,883,769 B2 4/2005 Shamoon
6,971,616 B1 12/2005 Lake
D518,525 S 4/2006 Bhavnani

* cited by examiner

CLIPBOARD ASSEMBLY

BACKGROUND OF THE INVENTION

This invention relates to a clipboard assembly. More particularly, it relates to an easily, substantially permanently assembled clipboard.

Clipboards are well known. In a traditional clipboard, a spring-loaded clip assembly may be mounted to a rigid backboard using fasteners such as screws or, more commonly, rivets. In some more recent clipboard assemblies, the spring-loaded clip assembly may be snap-fit onto the backboard. However, these more recent clipboard assemblies have required the molding of somewhat complex structures onto the backboards, or the clip assemblies were clipped over the edge, so that they protruded from the edge.

SUMMARY OF THE INVENTION

The present invention provides an easily, assembled clipboard, providing a savings of labor during assembly. Nevertheless, the clipboard is substantially permanently assembled.

In accordance with the present invention a clipboard may be assembled from a backboard and a clip assembly by sliding the clip assembly onto the top edge of the backboard. The backboard preferably has a pair of substantially parallel spaced-apart slots extending substantially perpendicularly from the top edge and the clip assembly preferably has a pair of rails that engage the slots. Flanges extending from the rails parallel to and behind the backboard prevent motion of the clip assembly perpendicular to the major plane of the backboard. Preferably, beads extend from the rails parallel to the flanges, but in front of the backboard. The backboard preferably is thus captured between the respective flange/bead pairs, to prevent undesirable flexing forward of the upper backboard portions outside the rails.

At least one detent, preferably in the backboard, mates with at least one locking projection, preferably in the form of a ramp, that preferably is on the clip assembly, to prevent motion of the clip assembly parallel to the major plane of the backboard in a disassembly direction. Alternatively, the detent may be in the clip assembly and the projection may be on the backboard. Although motion of the clip assembly parallel to the major plane of the backboard in the assembly direction is stopped when the flanges reach the ends of the slots, preferably there also is a lip extending substantially perpendicularly from the base of the clip assembly which engages the top edge of the backboard, also preventing motion of the clip assembly parallel to the major plane of the backboard in the assembly direction. The lip has a thickness parallel to the major plane of the backboard. The top edge of the backboard between the slots preferably is spaced inwardly from the top edge outside the slots by a distance substantially equal to the lip thickness, so that the lip and the top edge of the backboard outside the slots form a substantially continuous contour.

The major face of the backboard preferably is recessed inwardly in a direction perpendicular to the major face of the backboard, forming a recess that receives the base of the clip assembly, further stabilizing the clip assembly. The depth of the recess preferably is less than the thickness of the base of the clip assembly, so that the base protrudes above the recess for reasons discussed below.

The clip assembly preferably includes a base and a gripping member pivotably connected to the base (as by a hinge). A spring or other resilient element preferably urges a gripping edge toward the face of the backboard, preferably by outwardly urging an edge of the gripping member on the opposite side of the pivotable attachment from the gripping edge. The gripping member accordingly slopes downwardly from that opposite edge toward the gripping edge.

In order for the gripping edge to better grip any papers or other objects that a user may place under the clip, the gripping edge preferably should meet the clip assembly base along an area rather than along a line. Accordingly, the clip assembly base, which protrudes above the surface of the major face of the backboard as described above, preferably is beveled at an angle to match the contact angle of the gripping edge of the gripping member. Alternatively, the gripping edge itself may be beveled to meet the clip assembly base, or to meet the backboard itself if the clip assembly base does not protrude (e.g., because the recess is deeper and/or the clip assembly base is thinner), or both the base (if it protrudes) and the gripping edge may have complementary bevels.

Therefore, in accordance with the present invention, there is provided a clipboard assembly including a board member and a clip assembly. The board member has a board front face bounded by a board top edge, a board right edge, a board left edge and a board bottom edge, and a pair of substantially parallel slots extending from the board top edge in a direction substantially toward the board bottom edge. The board top edge between the slots is spaced away from the board top edge outside the slots, in a direction toward the board bottom edge, by a recess distance. The board member has a board thickness between the slots. The clip member has a clip base having a first major face and a second major face, and a gripping member pivotably connected to the first major face and having a gripping edge. A resilient element urges the gripping edge toward the first major face. The clip base has a clip base top edge having a lip thereon extending from, and substantially perpendicularly to, the second major face. The lip has a lip thickness, measured parallel to the first and second major faces, substantially equal to the recess distance. The base further has retention rails extending by a distance substantially equal to the base thickness from, and substantially perpendicularly to, the second major face. Each of the rails has a respective retention flange extending parallel to the second major face. The retention rails are inserted in the slots. A first one of the board front face between the slots and the second major face of the clip base has a locking projection thereon, and a second one of the board front face between the slots and the second major face of the clip base has a detent therein. The locking projection engages the detent to prevent removal of the clip member from the base. The lip and the board top edge form a substantially continuous contour.

BRIEF DESCRIPTION OF THE DRAWINGS

Further features of the invention, its nature and various advantages, will be apparent upon consideration of the following detailed description, taken in conjunction with the accompanying drawings, in which like reference characters refer to like parts throughout, and in which.

DETAILED DESCRIPTION OF THE INVENTION

Figure 1:
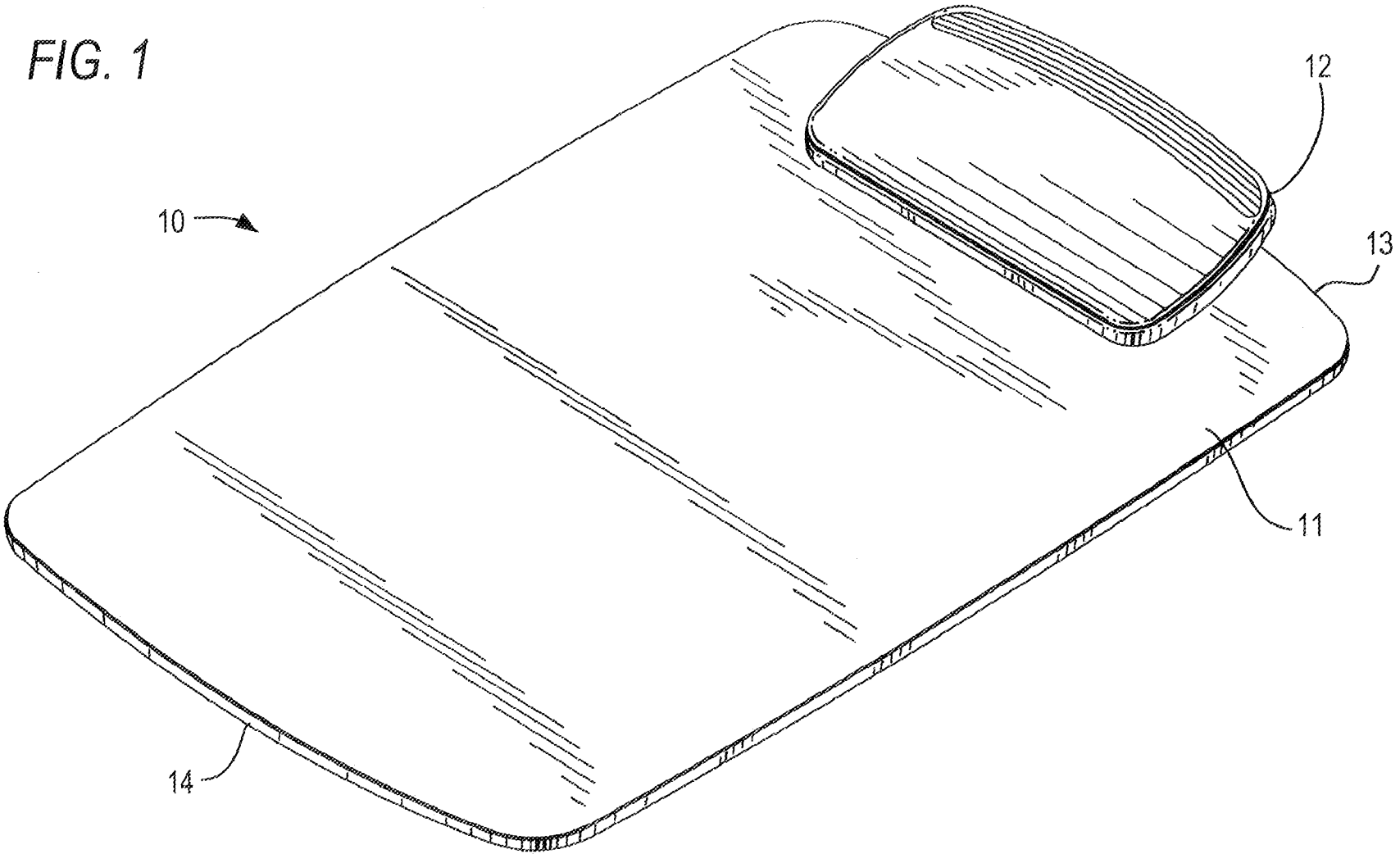
FIG. 1 is a perspective view, seen from the front, of a clipboard assembly in accordance with the present invention.
Figure 2:
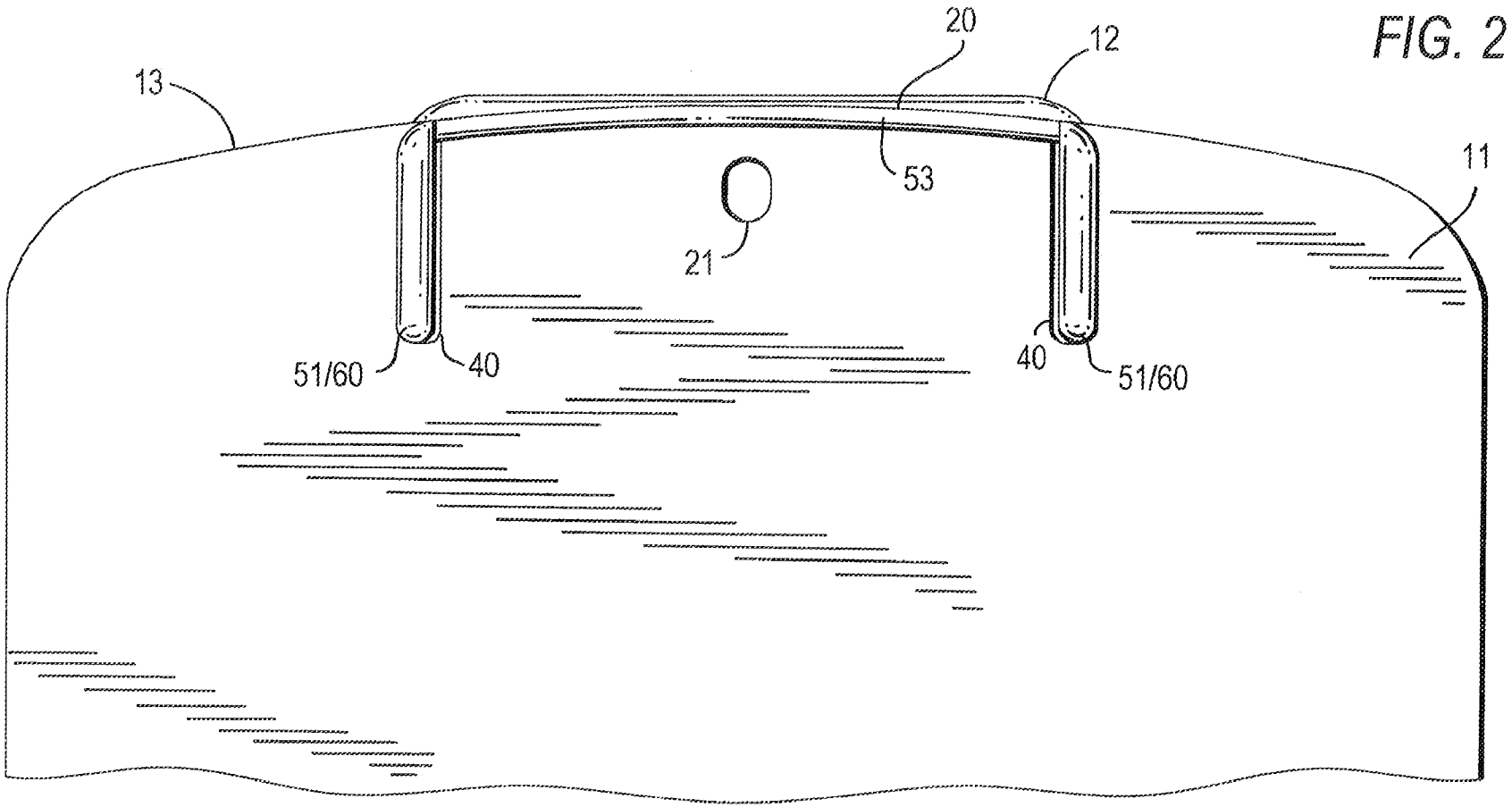
FIG. 2 is a fragmentary rear view of the clipboard assembly of FIG. 1, taken from line 2-2 of FIG. 1.
Figure 3:
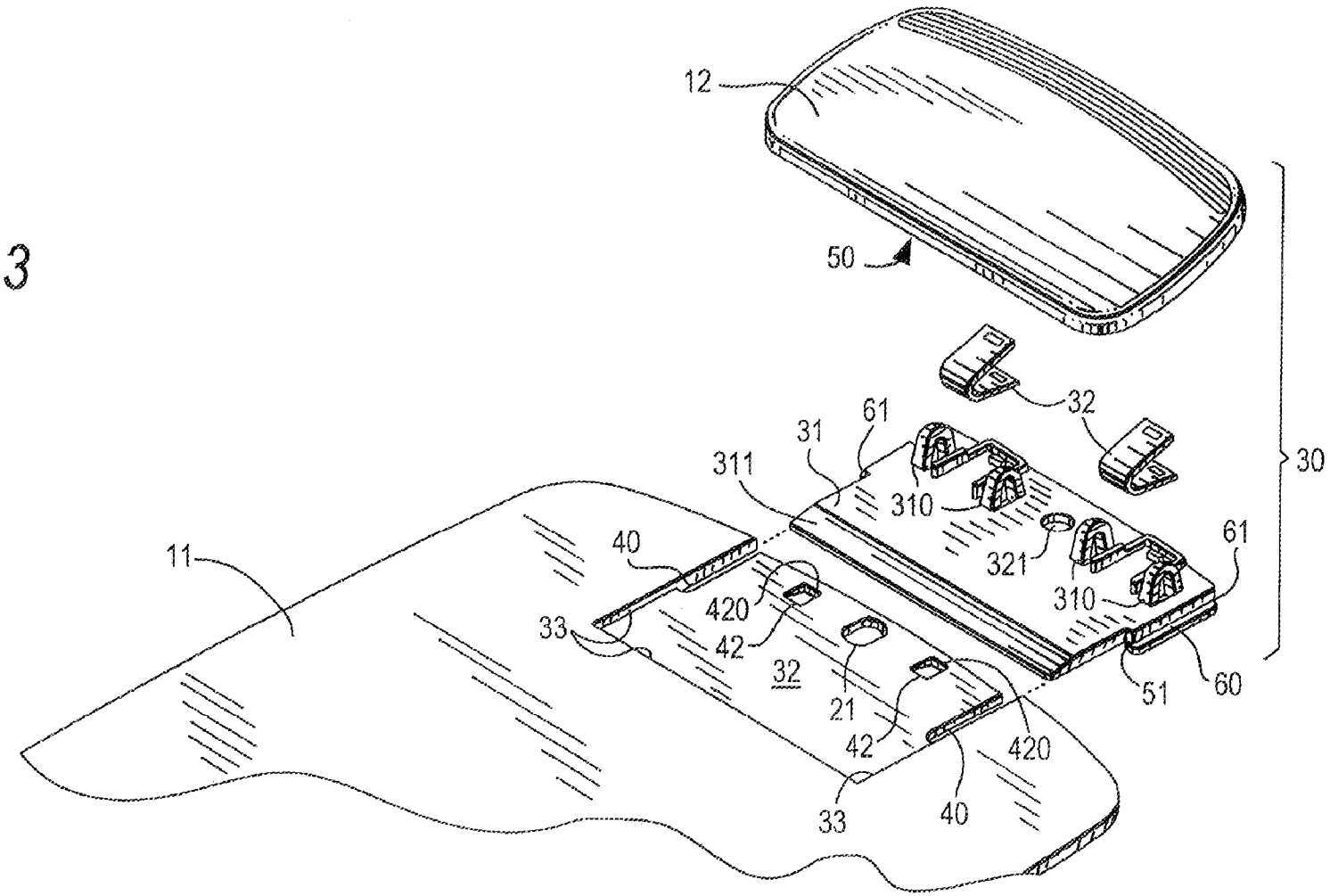
FIG. 3 is an exploded view of the clipboard assembly of FIGS. 1 and 2.
Figure 5:
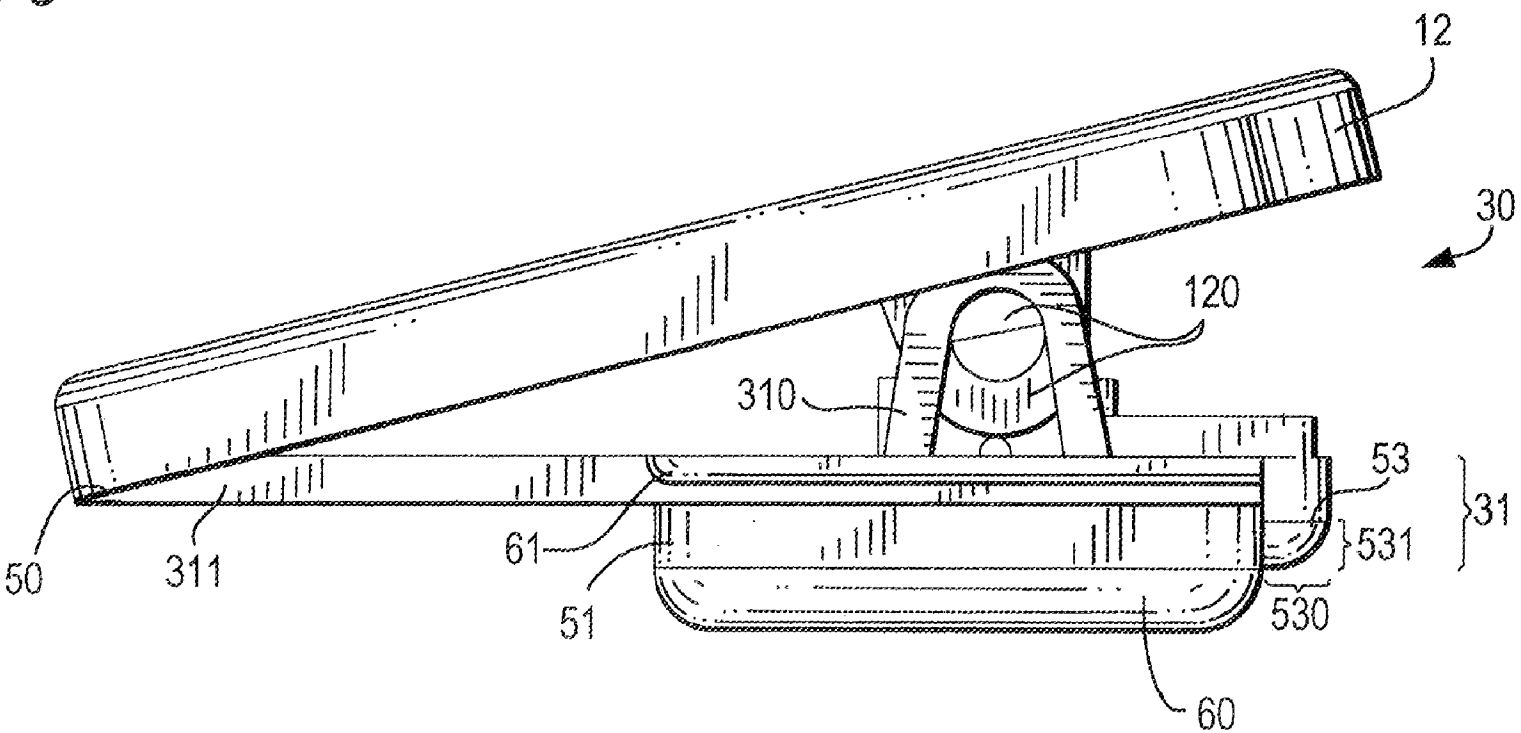
FIG. 5 is a side view of the clip assembly, taken from line 5-5 of FIG. 1.
Figure 6:
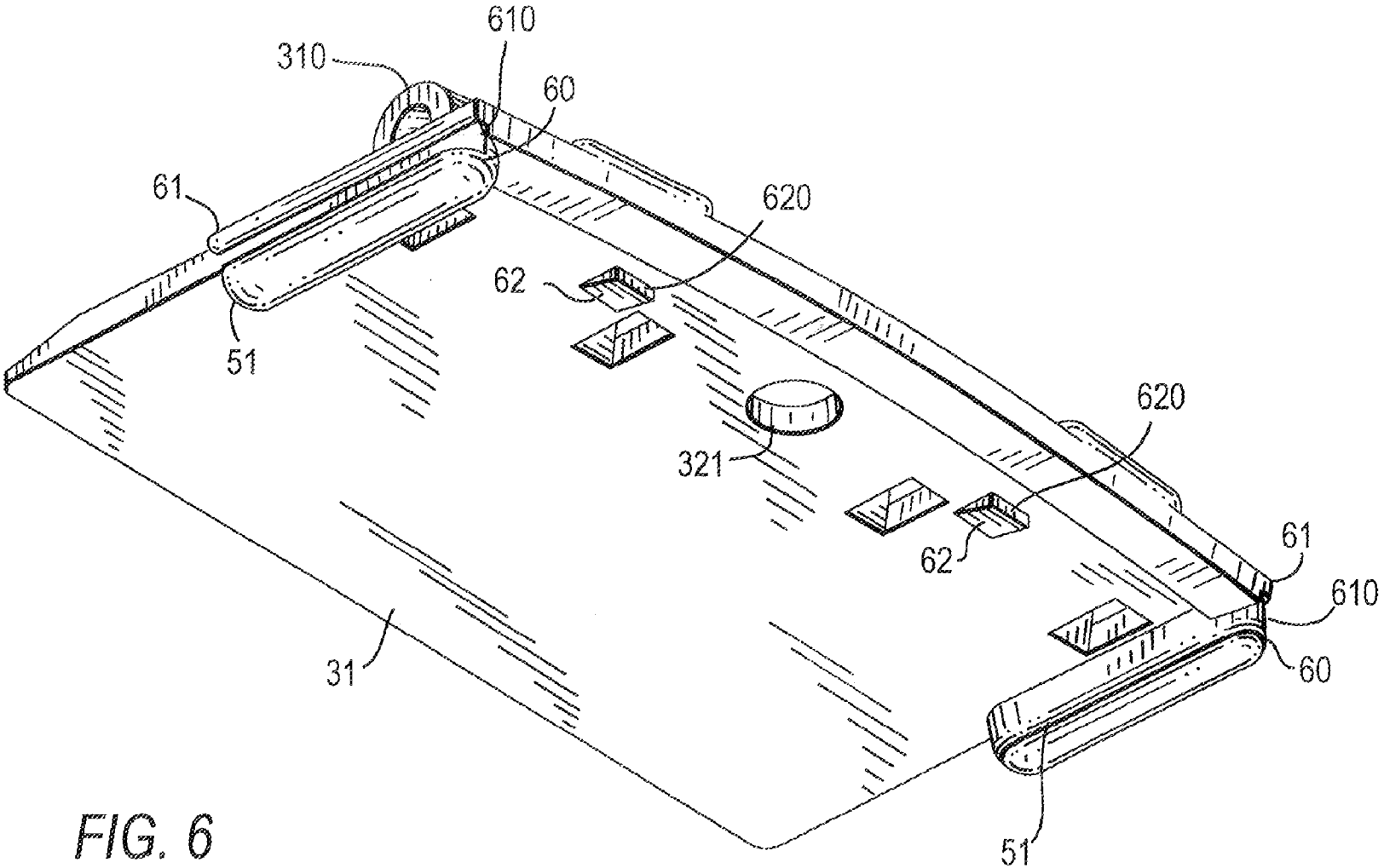
FIG. 6 is a perspective view of the underside of the clip base.

As seen primarily in FIGS. 1-3, a clipboard assembly 10 according to the present invention includes a backboard 11, which provides the surface against which a user may write, etc., on any papers held in clip 12. Clip 12 is the gripping member of a clip assembly 30, which also includes a clip base 31, to which clip or gripping member 12 is hingedly attached by base hinge portions 310 of clip base 31 and grip hinge portions 120 (see FIG. 5) of gripping member 12. Hinge portions 120, 310 preferably are integrally formed with gripping member 12 and clip base 31, respectively, but may be affixed in any other suitable manner to gripping member 12 or clip base 31. Springs 32, which may be metallic or of any suitable resilient polymeric material, or any other suitable type of spring or other resilient element (e.g., resilient foam, etc.), preferably press outwardly on the portion of gripping member 12 on the opposite side of hinge 120/310 from gripping edge 50, toward top edge 13 of backboard 11, urging gripping member 12 into a closed position in which its gripping edge 50 can grip papers against backboard 11.

Figure 4:
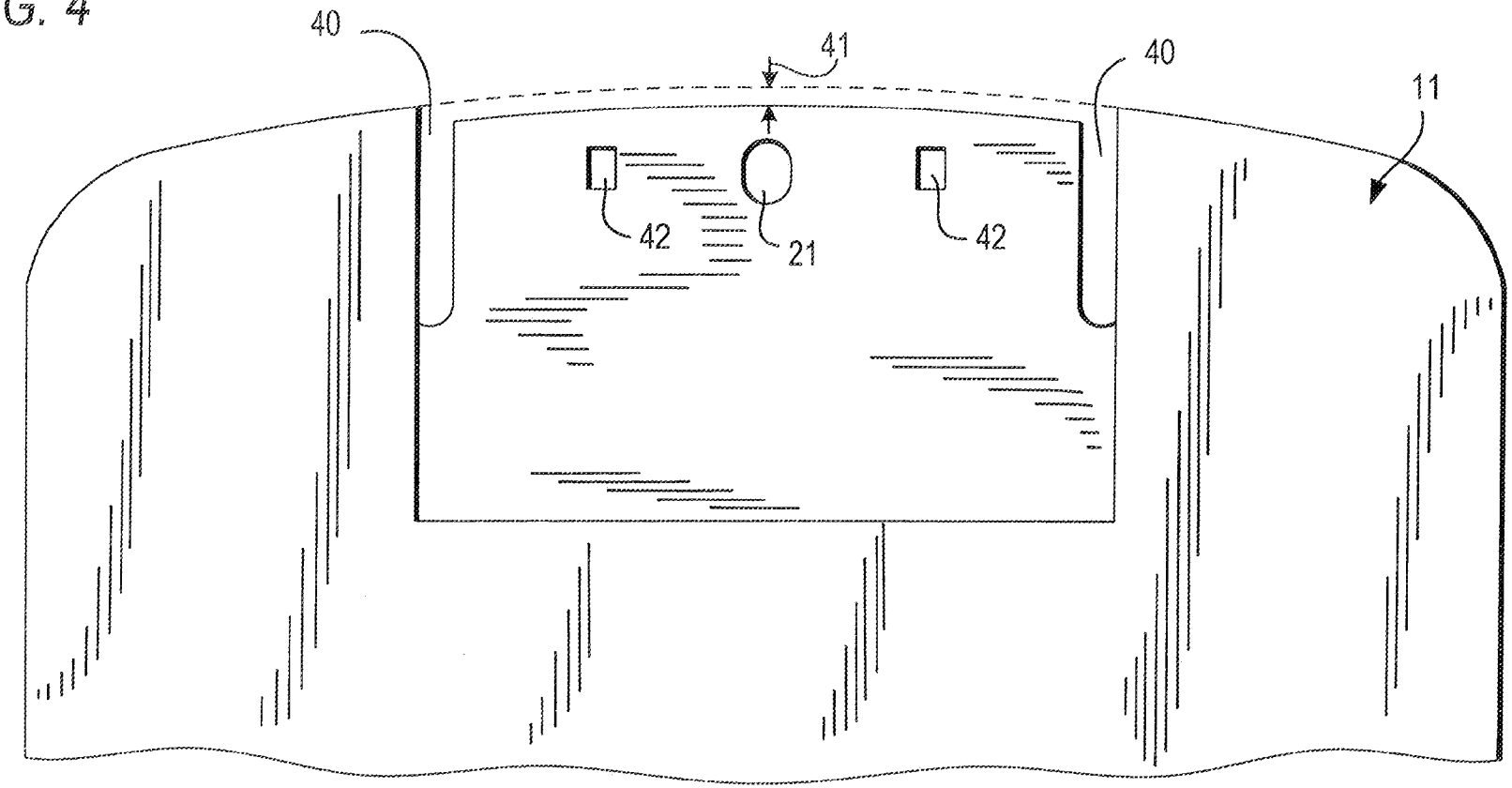
FIG. 4 is a fragmentary front view of the backboard of the clipboard assembly of FIGS. 1-3, taken from line 4-4 of FIG. 3.

In accordance with the invention, clip assembly 30 is secured to backboard 11 in such a way that, as seen in FIG. 2, clip base 31 does not protrude above the top edge or contour 13 of backboard 11, but rather forms a substantially continuous or smooth contour 20 with contour 13. As best seen in FIGS. 2-4, there are two substantially parallel slots 40 extending inwardly substantially perpendicularly from edge 13. A pair of rails 51 depend from clip base 31, and are oriented substantially perpendicularly to the major plane or face of clip base 31. From the bottom edge of each rail 51, a flange 60 extends substantially parallel to the major plane of clip base 31. Preferably, each flange 60 extends outwardly—i.e., away from the opposite rail, but flange 60 could also extend inwardly—i.e., toward the opposite rail. Indeed, both flanges 60 could extend in the same direction, so that one flange 60 extends outwardly while the other extends inwardly. When rails 51 are inserted into slots 40, flanges 60 preferably prevent motion of clip assembly 30 perpendicular to the major face or plane of backboard 11.

Optionally, but preferably, a respective bead 61 also extends outwardly from the upper edge of each rail 51, so that each respective bead/flange pair forms a channel 610 in which backboard 11 rests. This prevents undesirable forward flexing of the upper corner portions of backboard 11 outside slots 40, to avoid breakage of those corner portions, and to prevent undesirable snagging of objects between those portions and clip assembly 30.

Motion of clip assembly 30 parallel to the major face or plane of backboard 11 is prevented by several features. First, if a recess 32 is provided (as discussed below), edges 33 of recess 32 prevent lateral motion parallel to the major face or plane of backboard 11, as well as motion downward from top edge 13 toward bottom edge 14 of backboard 11. Second, the forward edges of rails 51/flanges 60 encountering the ends of slots 40 also stops motion downward from top edge 13 toward bottom edge 14 of backboard 11. Finally, the engagement of lip 53 of clip base 31 motion downward from top edge 13 toward bottom edge 14 of backboard 11.

As seen in FIG. 4, edge 13 between slots 40 is spaced away from edge 13 outside slots 40 by a recess distance 41 substantially equal to thickness 530 of lip 53. As a result, as best seen in FIG. 2, lip 53 and board top edge 13 form a substantially continuous contour 20. In FIG. 2, the projection of the top edge of clip 12 is visible beyond edge 13/contour 20, but edge 13/contour 20 is a substantially continuous contour. In addition, the projection 531 of lip 53 below clip base 31 preferably is substantially equal to the thickness of backboard 11 between rails 40 so that lip 53 preferably does not extend below the rear surface of backboard 11.

The fourth component of motion of clip assembly 30 parallel to the major face or plane of backboard 11—i.e., motion of clip assembly 30 away from bottom edge 14 so as to disassemble clipboard assembly 10—is prevented by the interaction of one, or, preferably two, detents 42 with one or, preferably, two, ramps 62. Preferably, each ramp 62 projects from the underside of clip base 31, extending further as it approaches lip 53, and presenting a substantially vertical wall 620 facing edge 13/lip 53. Similarly, a corresponding number of detents 42 are provided to engage with ramp(s) 62, with each detent 42 presenting a substantially vertical wall 420 facing away from edge 13. The interaction of walls 420 and 620 prevents motion of clip assembly 30 away from bottom edge 14 so as to disassemble clipboard assembly 10.

Preferably, at least backboard 11 is made from a material that is sufficiently resilient so that it deforms as ramp or ramps 62 pass over the area between edge 13 and detent or detents 42, but then resumes at least substantially its original shape so the walls 420 and 620 can interact as described. In particular, at least backboard 11, and preferably all of clipboard assembly 10, is made from a substantially rigid, but somewhat deformable plastic material such as high-impact polystyrene. However, many other plastics, as well as other materials, that have those characteristics could be used.

Preferably, each detent 42 has a ramp shape complementary to that of ramp 62, becoming deeper in the direction of wall 420. However, detent 42 could have any shape as long as it is at least as deep at wall 420 as the projection distance of wall 620 from clip base 31. Thus, detent 42 could have a uniform depth, or could even be deeper further from wall 420.

As mentioned above, a recess 32 preferably is provided in backboard 11 to receive clip base 31. However, recess 32 is optional. If recess 32 is provided, the thickness of clip base 31 could be such that clip base 31 is flush with the surface of backboard 11 (not shown). In that case, beads 61, if provided, preferably would extend from the first major face of clip base 31.

Preferably, however, whether or not recess 32 is provided, the thickness of clip base 31 is such that it extends above the surface of backboard 11 (if there is no recess 32, any thickness of clip base 31 will cause that result). Preferably, with clip base 31 extending above the surface of backboard 11, clip base 31 is provided with bevel 311, which preferably is bevelled at such an angle that gripping edge 50 is parallel to bevel 311 to provide a greater gripping area than a simple line of contact, to more securely hold papers, etc., under clip 12. Alternatively (not shown), gripping edge 50 could be bevelled instead of clip base 31, which would provide that larger gripping area whether clip base 31 extends above the surface of backboard 11 or is flush. As another alternative (also not shown), where clip base 31 extends above the surface of backboard 11, both clip base 31 and gripping edge 50 could be bevelled, with the total bevel angle of clip base 31 and gripping edge 50 being substantially the same as the bevel angle of bevel 311, to present a substantially equivalent gripping area.

Optionally, a hole 21 can be provided in backboard 11 between slots 40 and a corresponding hole 321 can be provided in clip base 31 so that holes 21 and 321 align to form a through hole in clipboard assembly 10 which can be used to hang clipboard assembly 10 on a hook or nail. Preferably, the hole is centered so that clipboard assembly 10 hangs straight.

As shown, flanges 60 protrude from the rear side of backboard 11. Alternatively (not shown), there may be recesses in the rear side of backboard 11 adjacent slots 40 to receive flanges 60, so that they do not protrude (in such an embodiment, flanges 60 would be thinner). In the embodiment shown, however, when clipboard assembly 10 is assembled, flanges 60 form feet that cause backboard 11 to stand away from any surface on which clipboard assembly 10 may be rested. This protects those portions of the rear side of backboard 11 that are held away from any such surface from being scuffed by that surface. The area between flanges 60 may be especially well-protected and may be a preferred place to have applied to it printed indicia. While indicia may be printed on any portion of backboard 11, this particular portion—between flanges 60—is preferred, insofar as any indicia would be better protected from scuffing than indicia printed on other portions.

One skilled in the art will appreciate that the present invention can be practiced by other than the described embodiments, which are presented for purposes of illustration and not of limitation, and the present invention is limited only by the claims that follow.

What is claimed is:

1. A clipboard assembly comprising:

a board member having:

a board front face and a board rear face, each of said board front face and said board rear face bounded by a board top edge, a board bottom edge, and board right and left edges, and a pair of substantially parallel slots extending from said board top edge in a direction substantially toward said board bottom edge, wherein:

said board top edge between said slots is spaced away by a recess distance, in a direction toward said board bottom edge, from said board top edge outside said slots, and said board member has a board thickness between said slots; and a clip member having:

a clip base having a first major face and a second major face, a gripping member pivotably connected to said first major face, and having a gripping edge, and a resilient element urging said gripping edge toward said first major face, wherein:

said clip base has a clip base top edge having a lip thereon extending from, substantially perpendicularly to, said second major face, said lip further having a lip thickness, measured parallel to said first and second major faces, substantially equal to said recess distance, said base further having retention rails extending by a distance substantially equal to said base thickness from, and substantially perpendicularly to, said second major face, each said rail having a respective retention flange extending parallel to said second major face;

said retention rails are inserted in said slots with said retention flanges adjacent said board rear face;

a first one of said board front face between said slots and said second major face of said clip base has a locking projection thereon, and a second one of said board front face between said slots and said second major face of said clip base has a detent therein;

said locking projection engages said detent to prevent removal of said clip member from said base; and said lip and said board top edge form a substantially continuous contour.

2. The clipboard assembly of claim 1 wherein:

each said retention rail has a respective retention bead extending therefrom adjacent said first major face and parallel to said respective retention flange; and said board member rests between said respective retention beads and said respective retention flanges.

3. The clipboard assembly of claim 1 wherein:

said lip extends an extension distance from said second major face; and said extension distance substantially equals said board thickness.

4. The clipboard assembly of claim 1 wherein:

said board member has a recess in said front face adjacent said top edge, between said slots; and said clip base rests within said recess.

5. The clipboard assembly of claim 4 wherein:

said clip base has a base thickness between said first major face and said second major face; and said recess has a recess depth at most equal to said base thickness.

6. The clipboard assembly of claim 5 wherein:

said recess depth is less than said base thickness, whereby said clip base protrudes from said recess;

a gripping edge of said gripping member meets said clip base; and at least one of said gripping edge and said clip base is bevelled where said gripping edge meets said clip base, whereby said gripping edge is parallel to said clip base where said gripping edge meets said clip base in absence of material gripped therebetween.

7. The clipboard assembly of claim 6 wherein said clip base is bevelled.

8. The clipboard assembly of claim 1 wherein:

a gripping edge of said gripping member meets said clip base; and at least one of said gripping edge and said clip base is bevelled where said gripping edge meets said clip base, whereby said gripping edge is parallel to said clip base where said gripping edge meets said clip base in absence of material gripped therebetween.

9. The clipboard assembly of claim 1 wherein:

a first one of said board front face between said slots and said second major face of said clip base has a second locking projection thereon, and a second one of said board front face between said slots and said second major face of said clip base has a second detent therein;

said second locking projection engages said second detent to prevent removal of said clip member from said base.

10. The clipboard assembly of claim 9 wherein:

each of said locking projections is a projecting ramp having a substantially vertical wall facing said respective top edges and having a ramp height; and each of said detents is a depression having a depth at least equal to said ramp height and having a substantially vertical wall facing away from said respective top edges.

11. The clipboard assembly of claim 10 wherein said depression is a depressed ramp.

12. The clipboard assembly of claim 1 wherein:

said locking projection is a projecting ramp having a substantially vertical wall facing said respective top edges and having a ramp height; and said detent is a depression having a depth at least equal to said ramp height and a substantially vertical wall facing away from said respective top edges.

13. The clipboard assembly of claim 12 wherein said depression is a depressed ramp.

14. The clipboard assembly of claim 1 wherein said retention flanges protrude from said board rear face, thereby forming feet that, when said clipboard assembly is rested on another surface, hold said board rear face away from said another surface, such that an area of said board rear face is protected from being scuffed by said another surface.

* * * * *